United States Patent [19]

Mazzocchia et al.

[11] Patent Number: 4,786,228

[45] Date of Patent: Nov. 22, 1988

[54] DEVICE FOR LOADING REFUSE INTO A BODY OF A REFUSE COLLECTING VEHICLE AND COMPACTING IR THEREIN

[76] Inventors: Leuco Mazzocchia; Mario Mazzocchia; Giuseppe Mazzocchia; Alfio Mazzocchia, all of Via Provinciale 37, 03011 Alatri (FR), Italy

[21] Appl. No.: 898,812

[22] Filed: Aug. 15, 1986

Related U.S. Application Data

[63] Continuation of Ser. No. 689,551, Jan. 7, 1985, abandoned.

[30] Foreign Application Priority Data

Jan. 6, 1984 [IT] Italy ..... 19052 A/84

[51] Int. Cl.[4] ..... B65F 3/14

[52] U.S. Cl. ..... 414/525.1; 100/233

[58] Field of Search ..... 414/293, 525 R; 100/283

[56] References Cited

U.S. PATENT DOCUMENTS 3,874,529 4/1975 Gollnick ..... 414/525 R
3,881,613 5/1975 Torimoto et al. ..... 414/525 R
3,889,828 6/1975 Smith ..... 414/525 R
4,050,594 9/1977 Gollnick ..... 414/525 R X
4,460,307 7/1984 Durant et al. ..... 414/525 R

FOREIGN PATENT DOCUMENTS 7811772 6/1980 Netherlands ..... 414/525 R

*Primary Examiner*—Robert J. Spar
*Assistant Examiner*—David A. Bucci
*Attorney, Agent, or Firm*—Michael J. Striker

[57] ABSTRACT

A device for loading refuse into, and compacting it inside a container carried by a refuse collecting vehicle, includes a link and a shovel extending throughout the width of the container and hinged together by a hinge. The link also has its other end hinged to a fixed structure of the vehicle in such a manner that the link is adapted only to swing about the axis of that hinge. Hydraulic jacks are provided for driving the link and shovel into motion. The hydraulic jacks operate such as to cause the free end of the shovel to describe, during the effective loading steps, a curved path that thoroughly follows the curvilinear shape of a bottom of a refuse receiving trough.

4 Claims, 5 Drawing Sheets

DEVICE FOR LOADING REFUSE INTO A BODY OF A REFUSE COLLECTING VEHICLE AND COMPACTING IR THEREIN

This application is a continuation of application Ser. No. 689,551, filed Jan. 7, 1985 now abandoned.

BACKGROUND OF THE INVENTION

This invention relates to a device for loading refuse into the body of a refuse collecting vehicle and for compacting refuse in said vehicle body, the device including a link and a shovel pivotally connected to one another and individually driven by means, preferably of the hydraulic type, which cause the link and shovel to perform such movements as to permit refuse that is being fed to a refuse receiving trough, to be picked up therefrom, transferred to a box-like body of the vehicle and compacted therein.

Refuse collecting vehicles usually include a loading body or chamber that is carried by the structure of the vehicle and is provided at the rear with a loading opening or inlet through which waste matter is fed to a receiving trough to be then pushed by suitable means to the interior of said chamber. Provided inside this chamber is a movable gate that is designed to form a front end wall of the chamber opposite to said inlet opening thereof, the movable gate being caused to move rearwardly during unloading in order to allow refuse to be discharged from the rear side of the chamber after the unit comprising the receiving trough and the loading and compacting device have been raised.

There are many types of refuse loading and compacting devices, i.e. means that are designed to transfer refuse from a receiving space to a collecting chamber, but all of them have drawbacks in that they are slow in operation, are only capable of compacting small quantities of refuse in a single step and are unable to accomodate refuse of some bulky nature.

Thus for example, a wide-spread device comprises a pair of swingable shovels, one of which is intended for bringing refuse up from the bottom of a receiving trough, while the other, which is to accurately operate in step with the first named shovel, is designed to push the raised refuse to the interior of a collecting box. Apart from the extreme complexity of construction of such a device, the shovel arrangement thereof does not allow a comparatively bulky refuse, such as a waste electro-domestic appliance, entering the collecting chamber.

Another prior known device makes use of a receiving trough provided with a bottom semi-circular in shape, and a shovel comprising an arm having a length equal to a radius of said bottom, the arm being so pivoted at a central part thereof as to be swingable through 180° to cause refuse collected during the successive strokes to be pushed to the interior of the collecting chamber alternatively on one side and the other of the swinging axis of the shovel. In this case too, a complicate kinematics is required for displacing the shovel and the problem again arises that bulky refuse is not able to be loaded due to the rear opening of the collecting chamber being for less than half its effective capacity available for use. Also the quantity of refuse that may be fed to the collecting chamber during each single loading step is small.

SUMMARY OF THE INVENTION

The above disadvantages are eliminated by the loading and compacting device according to the invention, which device is so constructed as to make the rear opening of a vehicle collecting body thoroughly available for use, that is to an extent that permits refuse of considerable bulky nature, such as waste pieces of electro-domestic appliance and the like, to be easily admitted thereto. Also, the device of the invention considerably increases the working rate, as compared to devices of a technique known, since it is able, in a single step, to load into a collecting chamber the entire contents of the receiving trough, the curvilinear-shaped bottom of which is designed to increase its capacity.

The above objects are attained by the refuse loading and compacting device according to the invention, wherein this device includes a link and a shovel shovel that extend throughout the width of a loading container and are hingedly connected to one another, the link also being hinged to a fixed structure of a vehicle in such a manner that said link is able to swing about the axis of said latter hinge point, while the shovel, which preferably is of the size substantially greater than that of the link, and the link can both swing about the hinge axis pivotally connecting the link and the shovel together, and perform translating motions due to the displacement of said hinge axis, which result from the swinging movement of the link. Means are provided for driving the link and shovel into separate and combined motions in order to permit the shovel to move down towards the receiving trough and to follow the curved shape of the bottom of the trough to transfer contents of the receiving trough to the loading chamber or container.

The means for driving the link and the shovel into motion are preferably hydraulic jacks that are arranged in pairs -one pair jacks for each - near the side walls of a vehicle, that are acting substantially on the center lines of the link and the shovel respectively, and that react upon the fixed structure of the concerned vehicle. As an alternative, an hydraulic motor could be substituted for the pair of hydraulic jacks to impart swinging motion to the shovel.

DETAILED DESCRIPTION OF THE PREFERRED EMBODIMENT

Figure 1:
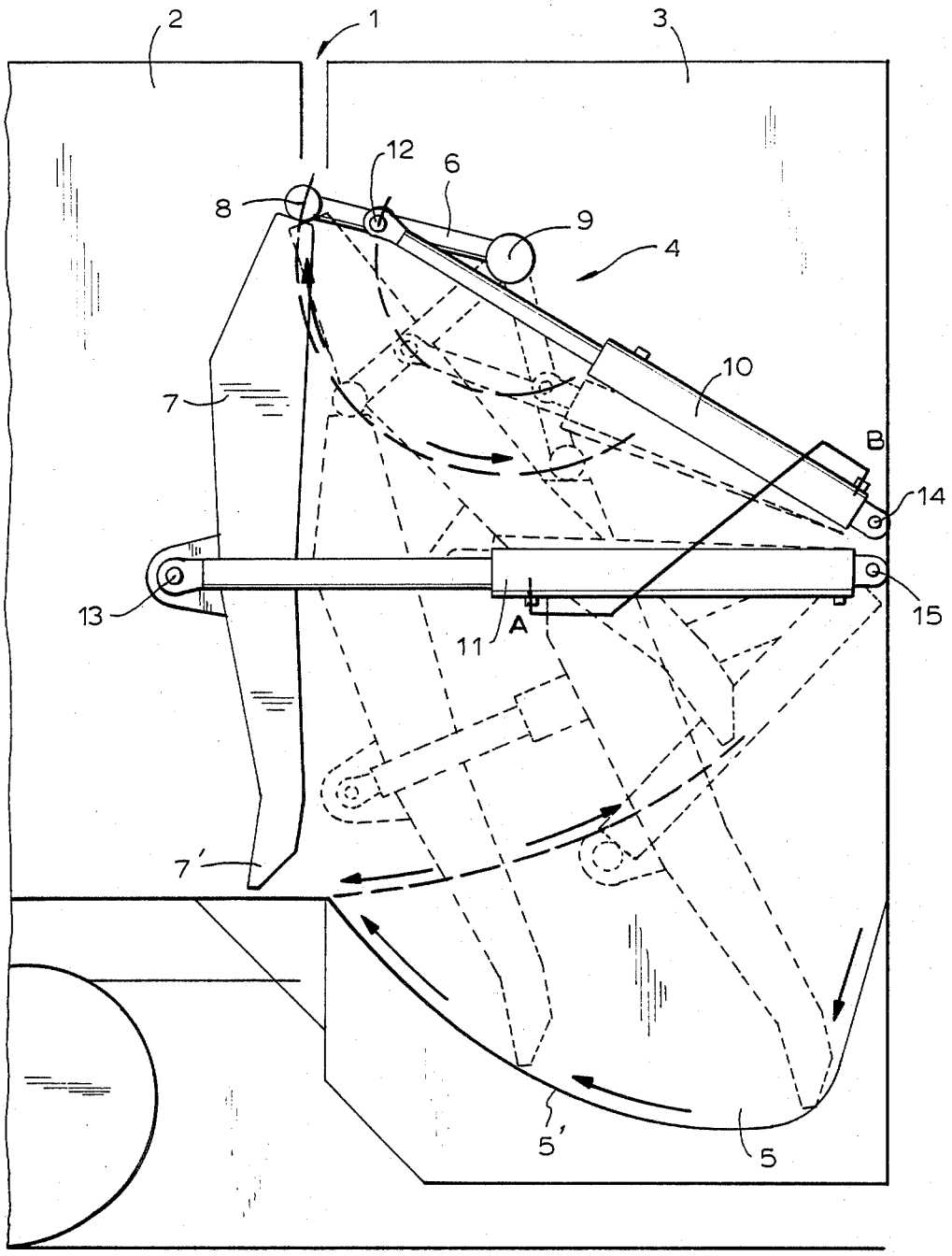
FIG. 1 is a side sectional view of a loading and compacting device according to the invention, the device being shown at the end of a loading step in solid lines and when in its main positions during a working cycle in broken lines.

With reference now to the above figures, generally indicated at 1 is a refuse-loading -compacting and -unloading vehicle of which only a rear part of a box-like body 2 is seen, the body 2 being open at its rear side to receive refuse therein. Provided rearwardly of the box 2 is a movable framework 3 in which the loading and compacting device according to the invention is housed, the device being generally indicated by the reference numeral 4 and having a refuse receiving space or trough 5 carried in a lower part thereof. The framework 3 is movable in that, when refuse loading is completed and in order to allow for the body 2 being emptied, the framework 3 is raised by causing it to rotate about a suspension axis that is arranged in an upper part of the body 2 according to a well known technique. During refuse loading and compacting operations, however, the framework 3 is rigidly locked with the body or chamber 2, that is to say the fixed structure of the vehicle. Thus, it is to be intended that the expression 'movable framework' could also be replaced by 'fixed structure of the vehicle' throughout the following description.

The device according to the invention essentially comprises a link 6 and a shovel 7 extending over the width of the chamber 2 and being hinged to one another by means of a hinge 8. The link 6 has its other end 9 hinged to the fixed structure of the vehicle in such a manner that said link 6, upon being appropriately driven, only can swing about the axis of hinge 9, by the hinge 8 being displaced over an arc of a circle.

The shovel 7 has its other end in a free condition and is usually substantially greater in size than is the link 6, the operation of loading refuse into the chamber 2 and compacting it therein being almost entirely accomplished by said shovel 7. The shovel 7 can swing about the axis of hinge 8 pivotally interconnecting the two shovels, and it is displaceable in a fixed relationship with the axis of said hinge 8.

The link 6 and shovel 7 are driven into motion under action of pairs of hydraulic jacks 10 and 11 respectively, which act through hinge means 12 and 13 respectively, sustantially upon the center lines of link 6 and shovel 7 and which react, also through hinged connections 14 and 15 respectively, upon a rear end portion of the fixed structure of the vehicle. The jacks 10, 11 of each pair thereof preferably are arranged in proximity to the side walls of the vehicle so as to allow for easy movements of the link and the shovel and prevent effective loading space from being obstructed. As a matter of fact, only one of the jacks of each pair thereof is to be seen in the side views of the figures, and other one being covered by the former.

For good operation of the device according to this invention, it is important that the curvilinear bottom 5' of the receiving trough 5 should be shaped so as to thoroughly match the path described by the free end 7' of shovel 7 during the loading step, which path is imposed through the kinematics by which the link 6 and shovel 7 are acted upon.

The loading and compacting device according to this invention operates on a continuous basis, in that refuse may be admitted to the receiving trough 5 from a rear inlet opening 16 in the movable framework 3 at any position occupied by the device 4 during a working cycle.

Operation of the loading device according to the invention will now be described with reference to the different working steps as shown in FIGS. 2 to 5 of the accompanying drawings.

Figure 2:
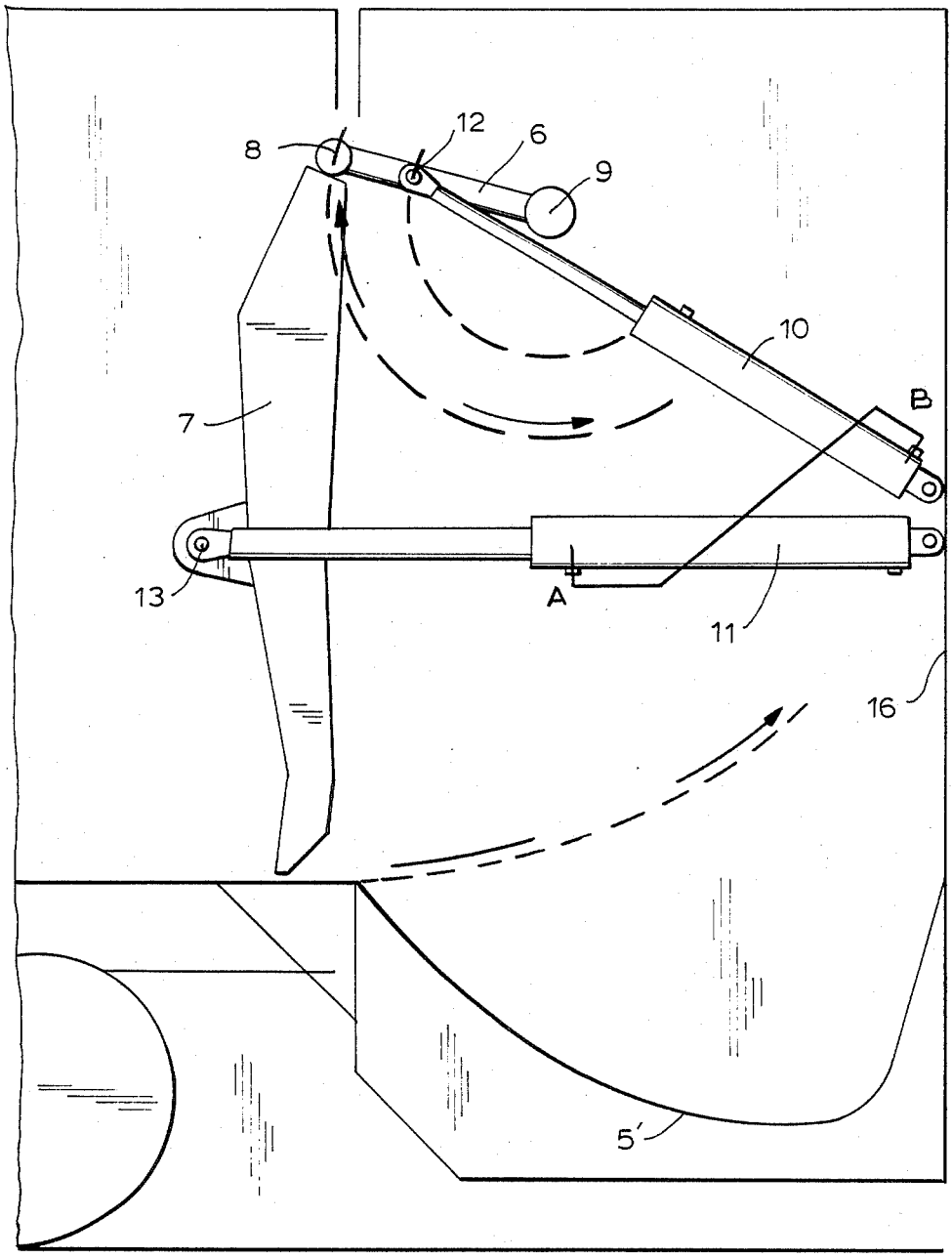
FIGS. 2 to 5 are side views showing the different positions of the loading-compacting device, as shown in FIG. 1, in a separate manner.
Figure 3:
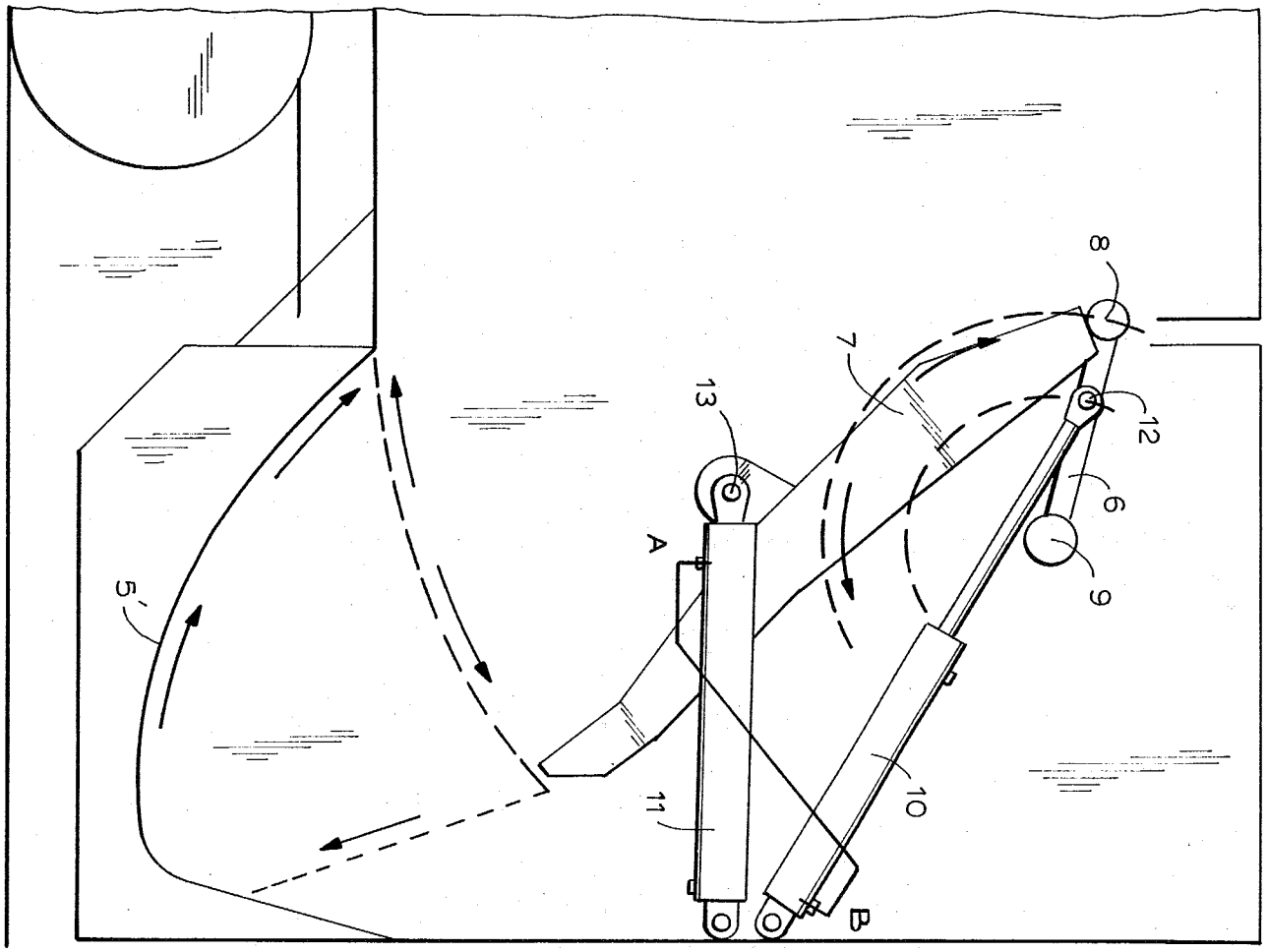

FIG. 2 shows the device when at the end of a loading and compacting cycle, with the link 6 being inclined slight upwardly and the lower shovel 7 in a right vertical position. Starting from that position, firstly the oil fluid in the pair of jacks 11 driving the shovel 7 is pumped out to completely retract the associated piston rods back to the position in FIG. 3 thereby causing the shovel 7 to perform a swinging motion about the axis of hinge 8 that is remained stationary during this step. At this time also the oil fluid in the pair of jacks 10 driving the link 6 is pumped out whereby this link 6 is caused to perform a rotation about the stationary hinge 9 to bring the device to the position shown in FIG. 4. It is to be noted that, at this stage, the displacement of the hinge 8 pivotally connecting the link 6 and shovel 7 to one another, causes the shovel 7 to displace downwardly, this displacement being permitted in that the axis of jacks 10 and 11 are swingable about their hinges 14 and 15 respectively.

Movements accomplished by the main component parts of the device according to the invention are indicated by dashed lines and reference arrows in the figures.

Figure 4:
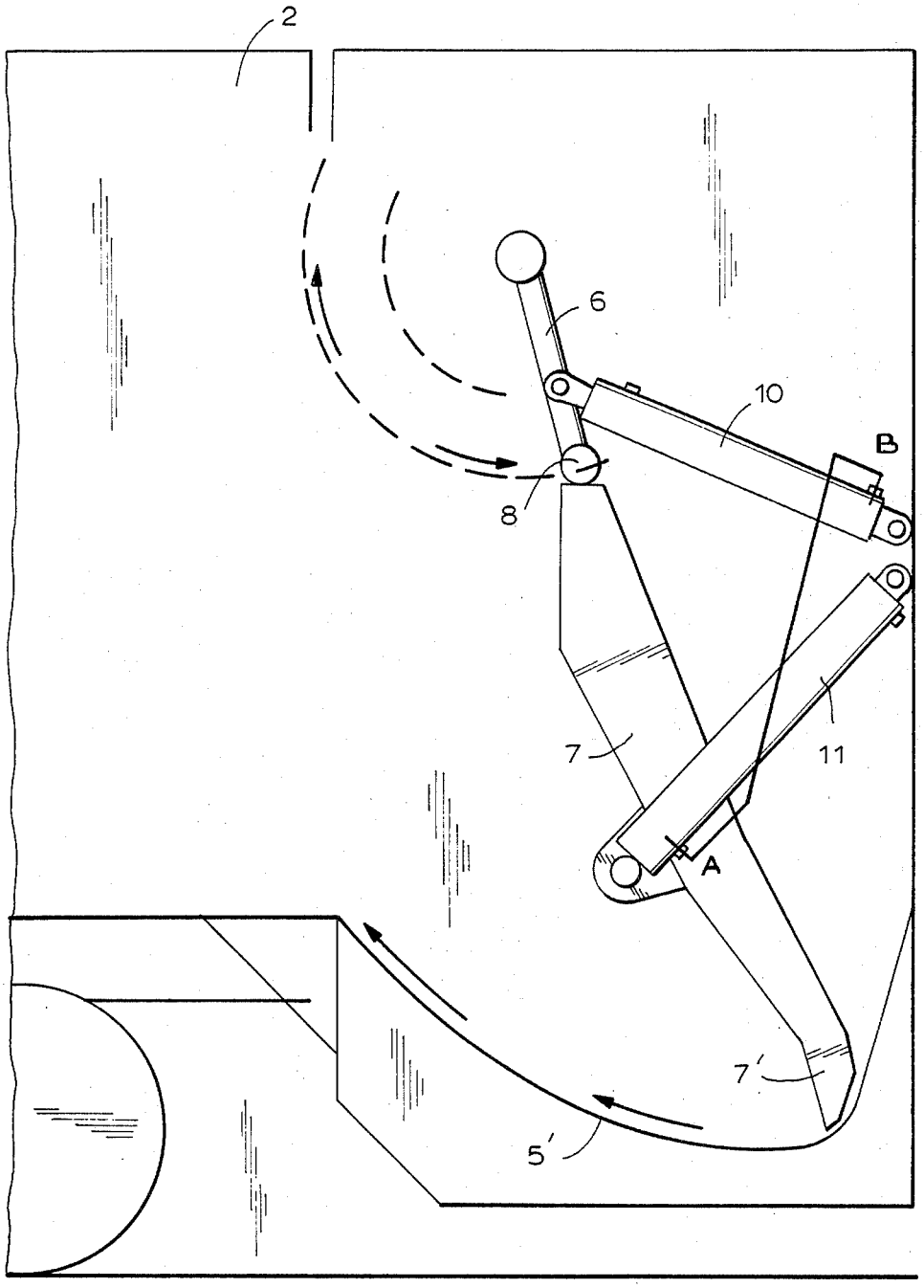
Figure 5:
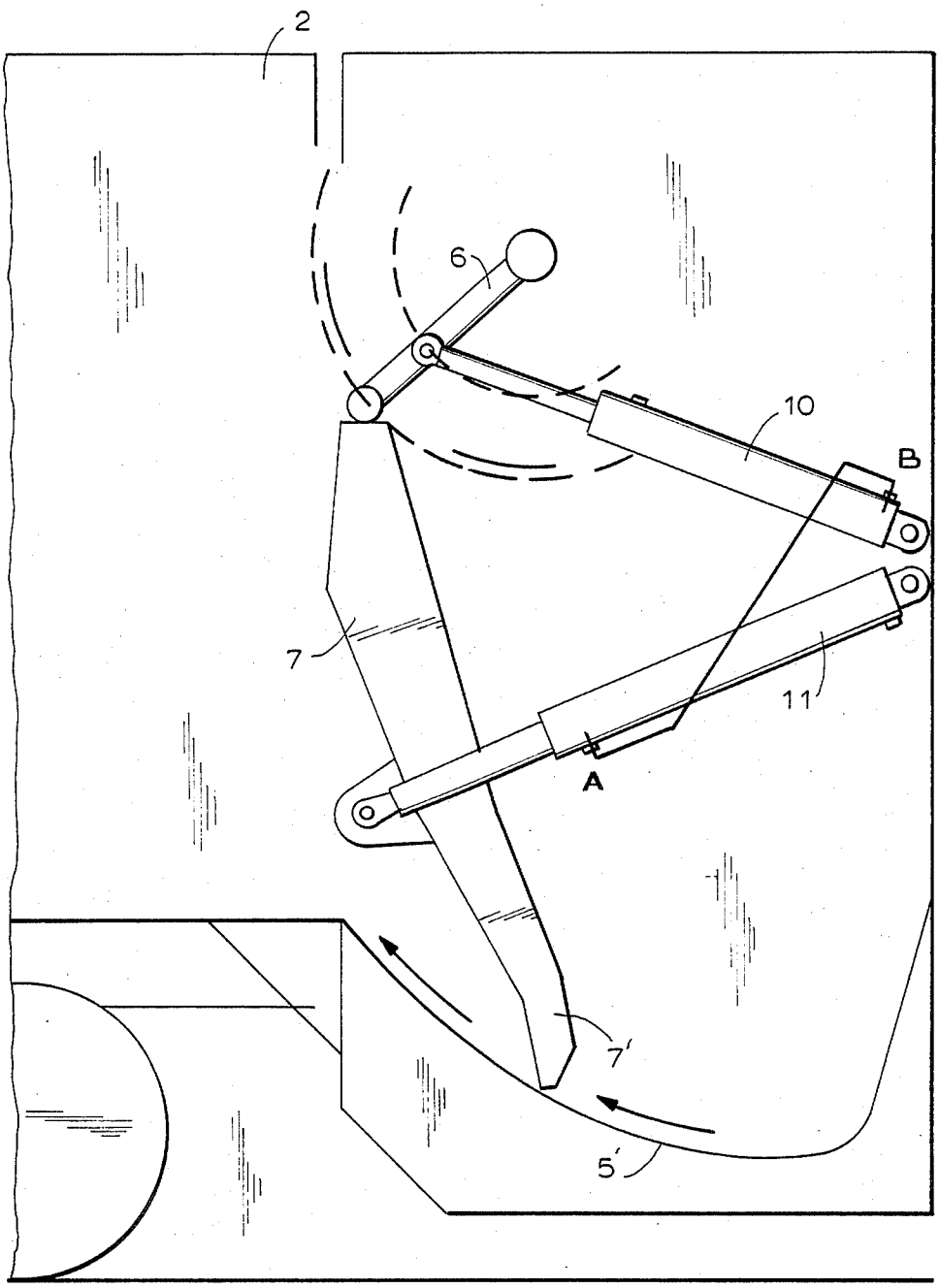

The FIG. 4 position in the starting position for the loading and compacting step. In this step both the pairs of jacks 10 and 11 are charged to simultaneously produce a clockwise rotation of link 6 and a motion of shovel 7 -which is the effective compacting shovel- this motion being such that the free end 7' of shovel 7 will describe a path that follows at the curvilinear-shaped bottom 5' of the receiving trough 5 as to cause refuse contained therein to be pushed to the interior of the container 2. FIG. 5 shows the device at an intermediate position thereof during the loading step, while FIG. 2 shows its position at the end of the loading and compacting cycle. It has to be noted that the pair of jacks 10 driving the link 6 complete their stroke shortly before the end of stroke of the pair of jacks 11 driving the compacting shovel 7 so that this shovel 7, being further acted upon by the associated jacks 11, may swing about the axis of hinge 8 to give the refuse a final compaction.

Starting from the FIG. 2 position a new working cycle may commence, which is identical to the preceding one in all respects.

It is to be observed that the above 'pumping out of oil' mentioned for the pair of jacks 10 and 11 has been considered for practical purposes only; it is apparent that there may be an "exchange of oil" between the two pairs of jacks, which exchange will, in fact, occur during the effective loading step in the working cycle, and it is outlined in the drawings by a line joining the points A and B of jacks 11 and 10 respectively. In any way, this is regarded as not being a feature of the invention so that it will not be discussed in any further detail herein.

As it should be appreciated, movements of link 6 and shovel 7 could be obtained by means other than the described hydraulic jacks 10 and 11, so long as the end 7' of shovel 7 is enabled to follow the curvilinear bottom 5' of the receiving trough 5. Thus for example, a hydraulic motor could be substituted for the pair of jacks 10 driving the link 6, which motor would cause the link 6 to perform a rotation about the axis of hinge 9 in the same manner as described herein before.

Obviously, many changes may be made to the refuse loading and compacting device that has been described and illustrated in relation to one preferred but not-limiting embodiment of the invention, all of said changes being intended to fall within the spirit and scope of the inventive principle as defined in the appended claims.

We claim:

1. A device for loading refuse into, and compacting it inside a container carried by a refuse collecting vehicle, of the type operated to pick refuse out of a receiving trough to feed it to said container, the loading and compacting device comprising a frame receiving refuse and mounted at an open end of said container and lockable therewith and having a front end facing said container and a rear end facing away from said container; a single elongated shovel (7) and a single link (6) both extending throughout the width of the container (2) and hingingly connected to each other by a hinge axis (8), said link (6) also having its other end hinged at a hinge (9) to said frame in such a manner that the link (6) is only enabled to swing about the hinge (9), while the shovel (7) is free at its other end (7') and is able to perform swinging motions about the hinge axis (8) and to perform displacements that are in direct relationship with displacements effected by the hinge axis (8); and means for driving said link and said shovel into motion and operating such that, during the effective loading step, they cause the free end (7') of the shovel (7) to describe a curved path which follows a curvilinear shape (5') of the bottom of the refuse receiving trough (5), said driving means including at least one pair of hydraulic jacks which are positioned behind said shovel, as viewed from said front end, and one of which is interconnected between a center of said shovel and said frame and the other of which is interconnected between a point on said link between said hinge axis (8) and said hinge (9), and a point on said frame located below and rearwardly of said hinge (9) and above the point of connection with said frame of said one jack, so that said hydraulic jacks act substantially on center lines of said link and said shovel, respectively, and react upon said frame, whereby said driving means operate so as to cause, at the commencement of each working cycle, the shovel (7) to perform a swinging motion about the hinge axis (8) towards the rear end of said frame, and then the link (6) to perform a rotation about said hinge (9) so as to bring the whole loading device to a start position for a next working cycle, in which the free other end (7') of said elongated shovel is in its remotest position from said front end of said frame, and then during the working cycle to cause said shovel to swing from said remotest position towards said front end of said frame to load the refuse into said container, wherein the device operates continually and refuse may be admitted into said trough at any position of the device, and wherein the curvilinear shape (5') of the bottom of the refuse receiving trough (5) is in relationship with the path that is described by the free end (7') of the shovel (7) as a result of the construction of said shovel and the action exerted thereon by the driving means so that no guide means are required to enable said shovel to describe said curved path.

2. The refuse loading and compacting device according to claim 1, wherein said jacks (10, 11) are connected to said link and said shovel, respectively by corresponding hinge means (12, 13) and are also connected by hinged connections (14, 15) to the fixed structure of the vehicle.

3. The device of claim 2, wherein said jacks are arranged close to the side walls of the fixed structure of the vehicle.

4. The device according to claim 1, wherein a hydraulic motor is provided for driving the link (6) into a swinging motion about the hinge (9).

* * * * *